United States Patent [19]

Dygve et al.

[11] 4,027,133

[45] May 31, 1977

[54] MICROWAVE RADIATORS

[75] Inventors: Hans G E Dygve; Per Olov G Risman, both of Huskvarna, Sweden

[73] Assignee: Husqvarna AB, Huskvarna, Sweden

[22] Filed: Dec. 5, 1975

[21] Appl. No.: 638,023

[30] Foreign Application Priority Data

Dec. 18, 1974 Sweden ..... 7415886

[52] U.S. Cl. ..... 219/10.55 F

[51] Int. Cl.[2] ..... H05B 9/06

[58] Field of Search ..... 219/10.55 F, 10.55 E, 219/10.55 R

[56] References Cited

UNITED STATES PATENTS 3,851,133 11/1974 Dygve et al. ..... 174/10.55 F

*Primary Examiner*—Arthur T. Grimley

[57] ABSTRACT

A microwave radiator assembly comprising an oven cavity, an antenna chamber communicating with the oven cavity by radiation openings and an antenna structure energized by a microwave generator. The introduction of radiation into the oven cavity is effected by an arrangement comprising a metallic plate in which said radiation openings are carried out and a coupling pin mounted in a microwave-transparent plate projecting through each opening forming coaxial paths into the oven chamber.

5 Claims, 2 Drawing Figures

MICROWAVE RADIATORS

BACKGROUND OF THE INVENTION

The present invention relates to a microwave radiator for use in an oven in which a housing forms an oven heating chamber adjacent a radiation chamber containing an element capable of transmitting energy to an object placed in said heating chamber with a high degree of efficiency.

Known ovens of this type suffer the disadvantage that irregularities in the resultant field pattern lead to the requirement for undesirably long treatment times. In addition, the oven heating chamber extends to a distance greater than a wave-length and thus forms resonant cavity for the radiation, so that standing waves exist and penetrate the object to cause uneven heating.

These disadvantages are to a certain extent eliminated by the use of an input device as described in U.S. Pat. No. 3,851,133 which relates to an arrangement with a special antenna radiation chamber coupled to an oven heating chamber.

One object of the present invention is to provide an improved form of such known input devices (applicators), comprising a simpler, more compact radiator assembly which affords greater possibilities of being adapted to different loads and oven cavities than is possible with known radiator assemblies.

SUMMARY OF THE INVENTION

The invention consists in a microwave radiator assembly for use in an oven having a heating chamber defined at the top and bottom thereof by a roof and a floor, said assembly comprising said roof or said floor in which are provided radiation openings for the introduction of microwave radiation into the heating chamber from an antenna cavity adjacent thereto and forming part of said assembly, said antenna cavity containing an antenna system coupled to a microwave source via a waveguide or transmission line, said roof or floor comprising a metallic plate in which a plurality of radiation openings are arranged, each embracing a respective coupling pin carried by said roof, said floor, or a plate of microwave-transparent material, and mounted thereon to project coaxially into the respective radiation openings to be coupled with said antenna system.

The field pattern in the object to be treated is of the induction field type. The expression "induction field oven" or "induction field radiator assembly" relates to devices whose function can be defined and analysed with the aid of Maxwell's equations, which can be studied in the literature and which need not be recited or studied here. The efficiency is dependent upon the energy-absorbing properties of the object, and a coupling system is so dimensioned as to obtain the higher efficiency possible for objects having the typical dielectric properties for which the apparatus is adapted. This means that a relatively small portion of energy should be radiated out into those portions of the heating chamber where no load is to be found; and the efficiency of the system is thereby increased simultaneously, as standing waves in the heating chamber of the oven are avoided. The small microwave effect which penetrates the object is reflected against the roof of the oven heating chamber and then partially penetrates again the object. The total efficiency of the energy transmission to the object is thus particularly good.

BRIEF DESCRIPTION OF THE DRAWINGS

The invention will now be described with reference to the accompanying drawings, in which.

DETAILED DESCRIPTION OF A PREFERRED EMBODIMENT

Figure 2:
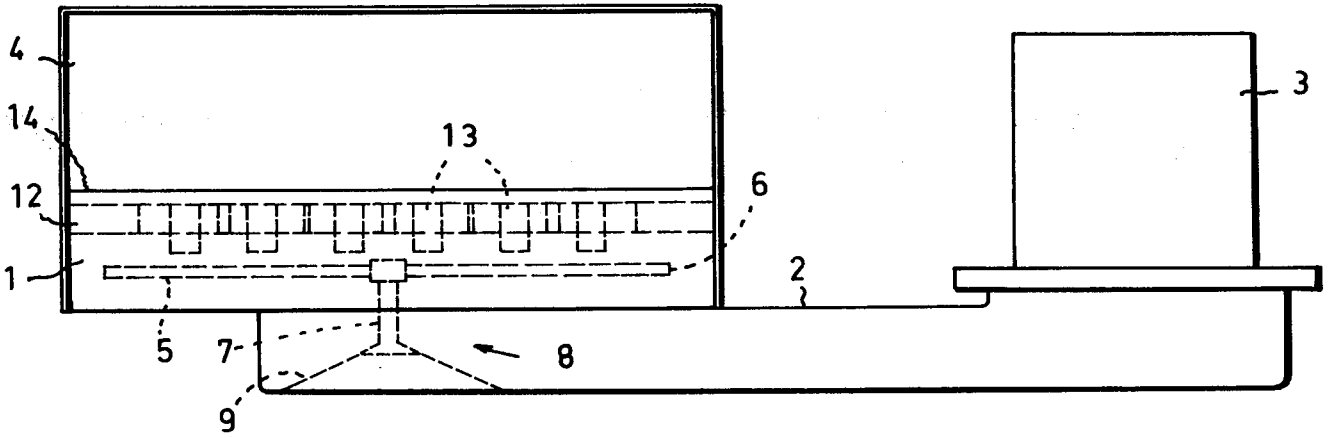
FIG. 2 is a vertical section through the embodiment shown in FIG. 1, and including an associated heating chamber.

The illustrated embodiment has a box-like antenna cavity 1, which is coupled via a waveguide 2 to a microwave energy source 3, e.g. a magnetron. This antenna cavity 1 which has a height less than one-half of the wave-length of the microwave energy, is incorporated in and is effective in the transfer of energy from the magnetron 3 to an adjacent oven heating chamber 4 located above the antenna cavity (FIG. 2). The remainder of said energy transfer coupling comprises a centre-fed antenna system formed by two radiator elements 5 and 6, energised via a coaxial line having a central conductor 7 which extends from a so-called door-knob mode transducer 8 in a waveguide 2. The waveguide 2 is of the type transmitting the $TE_{10}$ mode from the source 3 to conductor 7, the waveguide being closed at both ends. The magnetron is preferably placed in a space located to one side, or behind the antenna cavity. The so-called door-knob transformer is formed by a dome-shaped portion 9 extending from the lower wall of the waveguide, the centre conductor 7 of the coaxial line being connected to the centre of said domed portion, and constituting the central feeder line to the antenna system. The waveguide is provided with an input probe from the magnetron, which launches energy from the magnetron into the waveguide.

With the illustrated embodiment, the antenna system comprises two metal rods 5 and 6, secured centrally to the central line 7, which passes through a hole 10 in the upper side of the waveguide and the bottom of the antenna cavity. The metal rod is suitably coated with a layer of synthetic resin material or ceramic material to reduce the risk of a spark-over to the surrounding structure. The walls and the roof of the antenna cavity can also be provided with a similar coating for the same purpose.

Figure 1:
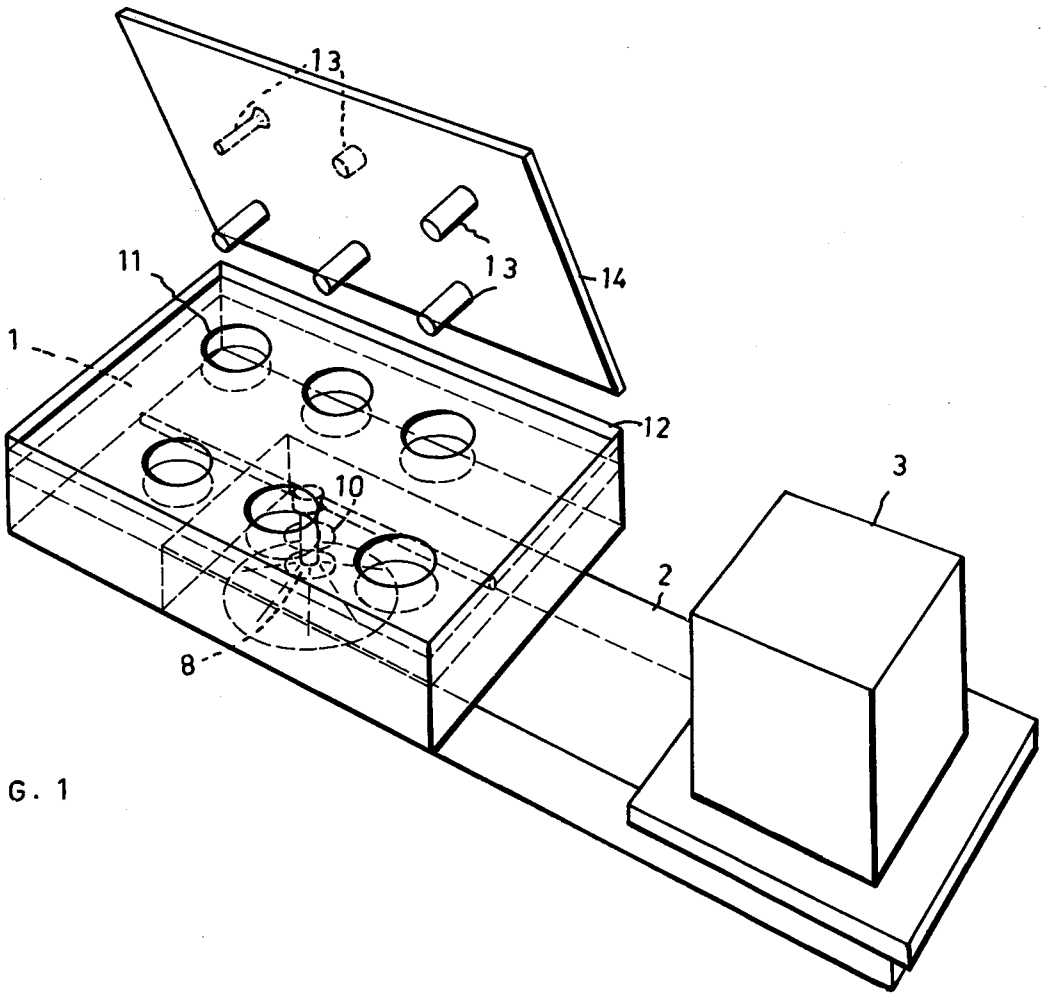
FIG. 1 is a perspective view of one exemplary embodiment of a microwave radiator assembly constructed in accordance with the present invention, together with an associated source.

From FIG. 2 it can be seen that radiation enters the oven heating chamber 4 by conducting energy through a number of holes 11 (FIG. 1) arranged in a metallic plate 12 which forms the upper side of the antenna cavity, and respective metallic coupling pins 13 project through each hole. These pins are mounted in a microwave-transparent plate 14, which is shown in FIG. 1 in an exploded view. Energy is coupled from the antenna cavity 1 through the individual coaxial paths formed by the holes 11 and pin 13, and the transmission characteristic of these paths is designed to give good matching to any overlying object that is to be heated. To provide for good impedance matching and a suitable field strength distribution in any particular case, metal pins of different cross-sectional shape e.g. cylindrical, conical, etc. may be used. The energy is transmitted through the coaxial paths as so-called TEM mode microwaves.

In the illustrated embodiment of the invention the antenna cavity 1 with its plate 12 can be formed together with the oven heating chamber 4 as a fixed basic unit and plates 14 with different coupling pins provided, to be exchangeable to allow for different loads, for example, sausages, hamburgers, sandwiches, etc. This can be an advantage in automatic microwave heaters, where the actual radiator assembly is not accessible to the user.

Equivalent antenna systems can be used instead of the described system, for example, a planar metallic structure parallel with the oven floor. The path between the waveguide and the antenna system may comprise a pin or probe projecting into the waveguide 2. It is also possible to supply the antenna system directly from the energy source 3 via a coaxial line. The coupling pins in FIG. 1 have been shown in different forms, and placed in rows. Naturally, both the positioning and the design of the pins can be varied without departing from the inventive concept. In another embodiment the pins are not mounted in a transparent plate but in the roof of the antenna system. These pins function as reactance pins which couple the field to the oven heating chamber. The difference with respect to the former described embodiment is primarily the mechanical attachment of the pins. A further form is one in which the upper end of U-shaped pins are mounted in a perforated metal plate, the supply of energy to the oven heating chamber then no longer being capacitive, but inductive using so-called loop-feeding. It is assumed that the material from which the pins are made is a metal, although pins made of a low-loss dielectric material can be used.

What we claim is:

1. A microwave radiator assembly for use in an oven, having a heating chamber defined at the top and bottom thereof by a roof and a floor, one of which comprises a plate in which are provided radiation openings for the introduction of microwave radiation into the heating chamber from an antenna cavity adjacent thereto and forming part of said assembly, said antenna cavity containing an antenna system coupled to a microwave source via a waveguide or transmission line, said plate comprising a metallic plate in which a plurality of radiation openings are arranged, each embracing a respective coupling pin carried by a plate of microwave-transparent material, and mounted thereon to project coaxially into the respectively radiation openings to be coupled with said antenna system.

2. A microwave radiator assembly as claimed in claim 1, in which said plate of microwave-transparent material is located within the heating chamber or the antenna cavity, and said pins each pass through said plate.

3. A microwave radiator assembly as claimed in claim 2, in which said radiation openings are formed in a floor for said heating chamber on which said microwave-transparent plate is positioned.

4. A microwave radiator assembly as claimed in claim 3, in which each said coupling pin is cylindrical.

5. A microwave radiator assembly as claimed in claim 4, in which a plurality of said microwave-transparent plates are provided, each having coupling pins of mutually different type.

* * * * *